US010422498B2

(12) United States Patent
Durand

(10) Patent No.: US 10,422,498 B2
(45) Date of Patent: Sep. 24, 2019

(54) APPARATUS FOR RADIATING LIGHT FROM A VIRTUAL SOURCE

(71) Applicant: Ford Global Technologies, LLC, Dearborn, MI (US)

(72) Inventor: Jason Durand, Essex (CA)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 16/122,279

(22) Filed: Sep. 5, 2018

(65) Prior Publication Data

US 2019/0003671 A1 Jan. 3, 2019

Related U.S. Application Data

(62) Division of application No. 15/228,198, filed on Aug. 4, 2016, now Pat. No. 10,100,999, which is a division (Continued)

(51) Int. Cl.
*F21S 41/141* (2018.01)
*F21S 41/143* (2018.01)

(Continued)

(52) U.S. Cl.
CPC ..... *F21S 41/141* (2018.01); *F21S 41/143* (2018.01); *F21S 41/285* (2018.01); *F21S 41/32* (2018.01);

(Continued)

(58) Field of Classification Search
CPC ..... F21S 41/141; F21S 41/143; F21S 43/14; F21S 43/40; F21V 5/046; G02B 3/04; G02B 3/06

See application file for complete search history.

(56) References Cited

U.S. PATENT DOCUMENTS 6,062,710 A 5/2000 Hewitt
7,142,769 B2 * 11/2006 Hsieh ..... F21V 7/0091 385/146

(Continued)

OTHER PUBLICATIONS

Joo et al.; "LED Beam Shaping Lens Based on the Near-Field Illumination;" Optics Express; Dec. 21, 2009; pp. 23449-23458; vol. 17, No. 26; Optical Society of America.

(Continued)

*Primary Examiner* — Sean P Gramling
(74) *Attorney, Agent, or Firm* — Vichit Chea; Price Heneveld LLP

(57) ABSTRACT

A lighting assembly that includes an LED source that generates a light cone (solid angle); and a transparent near field lens having a front surface, a collimating surface, and an aspherical groove. The collimating surface collimates the light cone into a beam that reflects off of the front surface toward the aspherical groove, and the aspherical groove directs the beam away from the lens as an exit cone from a virtual focal point, positive virtual focal ring or a negative virtual focal ring. The exit cone may be evenly distributed, substantially forward or substantially rearward from the virtual focal point or virtual focal ring. Parabolic or aparabolic reflectors can be employed with lighting assemblies having a virtual focal point or virtual focal ring, respectively, to reflect the exit cone in a vehicular exterior lighting pattern.

20 Claims, 10 Drawing Sheets

Related U.S. Application Data of application No. 14/066,795, filed on Oct. 30, 2013, now Pat. No. 9,435,504.

(51) Int. Cl.

| | |
|---|---|
| ***F21S 41/20*** | (2018.01) |
| ***F21S 41/32*** | (2018.01) |
| ***F21S 41/37*** | (2018.01) |
| ***F21S 43/14*** | (2018.01) |
| ***F21S 43/20*** | (2018.01) |
| ***F21S 43/31*** | (2018.01) |
| ***F21S 43/33*** | (2018.01) |
| ***F21S 43/40*** | (2018.01) |

(52) U.S. Cl.

CPC ..... *F21S 41/322* (2018.01); *F21S 41/37* (2018.01); *F21S 43/14* (2018.01); *F21S 43/26* (2018.01); *F21S 43/31* (2018.01); *F21S 43/315* (2018.01); *F21S 43/33* (2018.01); *F21S 43/40* (2018.01)

(56) References Cited

U.S. PATENT DOCUMENTS

| | | | | |
|---|---|---|---|---|
| 7,153,002 | B2 | 12/2006 | Kim et al. | |
| 7,207,700 | B2 | 4/2007 | Fallahi et al. | |
| 7,401,948 | B2 | 7/2008 | Chinniah et al. | |
| 7,466,075 | B2 | 12/2008 | Cok et al. | |
| 7,489,453 | B2 | 2/2009 | Chinniah et al. | |
| 7,520,650 | B2 | 4/2009 | Smith | |
| 7,703,950 | B2 | 4/2010 | Ewert et al. | |
| 7,942,559 | B2 | 5/2011 | Holder et al. | |
| 7,976,192 | B2 | 7/2011 | Chinniah et al. | |
| 8,297,799 | B2 * | 10/2012 | Chou | F21V 5/04 359/725 |
| 8,757,845 | B2 * | 6/2014 | Tseng | F21V 3/0625 362/296.07 |
| 8,979,320 | B1 * | 3/2015 | McDermott | G02B 19/0028 362/299 |
| 2001/0021110 | A1 | 9/2001 | Nakayama et al. | |
| 2004/0213001 | A1 | 10/2004 | Sayers et al. | |
| 2005/0138852 | A1 | 6/2005 | Yamauchi | |
| 2006/0208267 | A1 * | 9/2006 | Chin | H01L 33/58 257/98 |
| 2007/0091613 | A1 | 4/2007 | Lee et al. | |
| 2008/0304277 | A1 | 12/2008 | Chinniah et al. | |
| 2008/0310028 | A1 | 12/2008 | Chinniah et al. | |
| 2009/0003002 | A1 | 1/2009 | Sato | |
| 2009/0196047 | A1 * | 8/2009 | Chinniah | F21V 5/046 362/297 |
| 2011/0317442 | A1 | 12/2011 | Makiuchi | |
| 2012/0044700 | A1 * | 2/2012 | Chen | F21V 3/00 362/311.02 |
| 2012/0075849 | A1 | 3/2012 | Potter | |
| 2012/0120672 | A1 | 5/2012 | Stagg et al. | |
| 2012/0268940 | A1 | 10/2012 | Sahlin et al. | |
| 2013/0265791 | A1 | 10/2013 | Dassanayake et al. | |
| 2014/0063816 | A1 * | 3/2014 | Seki | F21V 5/04 362/309 |

OTHER PUBLICATIONS

Chinniah et al.; "Construction and Application of Near Field (TIR Type) Lenses for Automotive Lighting Functions;" Technical Papers; dated Apr. 16, 2007; last accessed Jan. 7, 2013; http://papers.sae.org/2007-01-1040/; SAE International.

* cited by examiner

APPARATUS FOR RADIATING LIGHT FROM A VIRTUAL SOURCE

CROSS-REFERENCE TO RELATED APPLICATIONS

This application is a divisional of U.S. patent application Ser. No. 15/228,198, filed on Aug. 4, 2016, entitled "APPARATUS FOR RADIATING LIGHT FROM A VIRTUAL SOURCE,", now issued as U.S. Pat. No. 10,100,999, which is a divisional application of U.S. patent application Ser. No. 14/066,795, filed on Oct. 30, 2013, entitled "APPARATUS FOR RADIATING LIGHT FROM A VIRTUAL SOURCE," now issued as U.S. Pat. No. 9,435,504, the contents of which are relied upon and incorporated herein by reference in their entirety, and the benefit of priority under 35 U.S.C. §§ 120, 121 is hereby claimed.

FIELD OF THE INVENTION

The present invention generally relates to lighting assemblies, particularly LED-based lighting assemblies for use in vehicular lighting applications.

BACKGROUND OF THE INVENTION

Automotive lighting is significantly regulated by the federal government. Emitted light patterns, particularly those used in exterior lighting applications, must be controlled to meet federal regulations. The regulations exist to ensure the safety of drivers, pedestrians and other drivers in the environment of the vehicle. LED source technologies are rapidly becoming an efficient alternative to incandescent light bulb technologies. However, LED sources have a significant drawback in that they produce highly directional light. The directional nature of the light produced by LED sources has inhibited the development of LED-based lighting assemblies that can meet federal regulations, particularly in vehicular exterior lighting applications.

An LED source significantly differs from an incandescent light source in the form of the light it produces. Whereas light emanates from an incandescent light bulb in nearly 360°, light is emitted from an LED from one surface in the form of a cone (solid angle). Near-field lenses (NFLs) are used today to collimate the cone (solid angle) of light generated by an LED, but do little to increase the spread of light comparable to that produced by an incandescent bulb. Further, LED-based light that is collimated by a conventional NFL does not possess a focal point, usually a prerequisite for engineering other components, such as reflectors, that can also be employed in vehicular exterior lighting applications.

Accordingly, there is a need for an LED-based lighting assembly that can substantially replicate the light spread of an incandescent bulb and facilitate various packaging for use in certain applications, particularly vehicular exterior lighting applications.

SUMMARY OF THE INVENTION

According to one aspect of the present invention, a lighting assembly is provided. The lighting assembly includes: an LED source that generates a light cone; and a transparent near field lens having a front surface, a collimating surface, and an aspherical groove. The collimating surface collimates the light cone into a beam that reflects off of the front surface toward the aspherical groove, the groove directing the beam away from the lens as an exit cone from a virtual focal ring.

According to another aspect of the present invention, a lighting assembly is provided. The lighting assembly includes: an LED source; a transparent near field lens having a front surface, a collimating surface, and an aspherical groove shaped to direct a light cone from the source and collimating surface as an exit cone distributed from a virtual focal ring in a substantially vehicle rearward collective direction relative to the focal ring; and a parabolic reflector for reflecting the exit cone into a vehicular light pattern.

According to a further aspect of the present invention, a lighting assembly is provided. The lighting assembly includes: an LED source; a transparent near field lens having a front surface, a collimating surface, and an aspherical groove shaped to direct a light cone from the source and collimating surface as an exit cone distributed from a virtual focal ring in a substantially vehicle forward collective direction relative to the focal ring; and a parabolic reflector for reflecting the exit cone into a vehicular light pattern.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one with ordinary skill in the art to variously employ the present invention.

Figure 1:
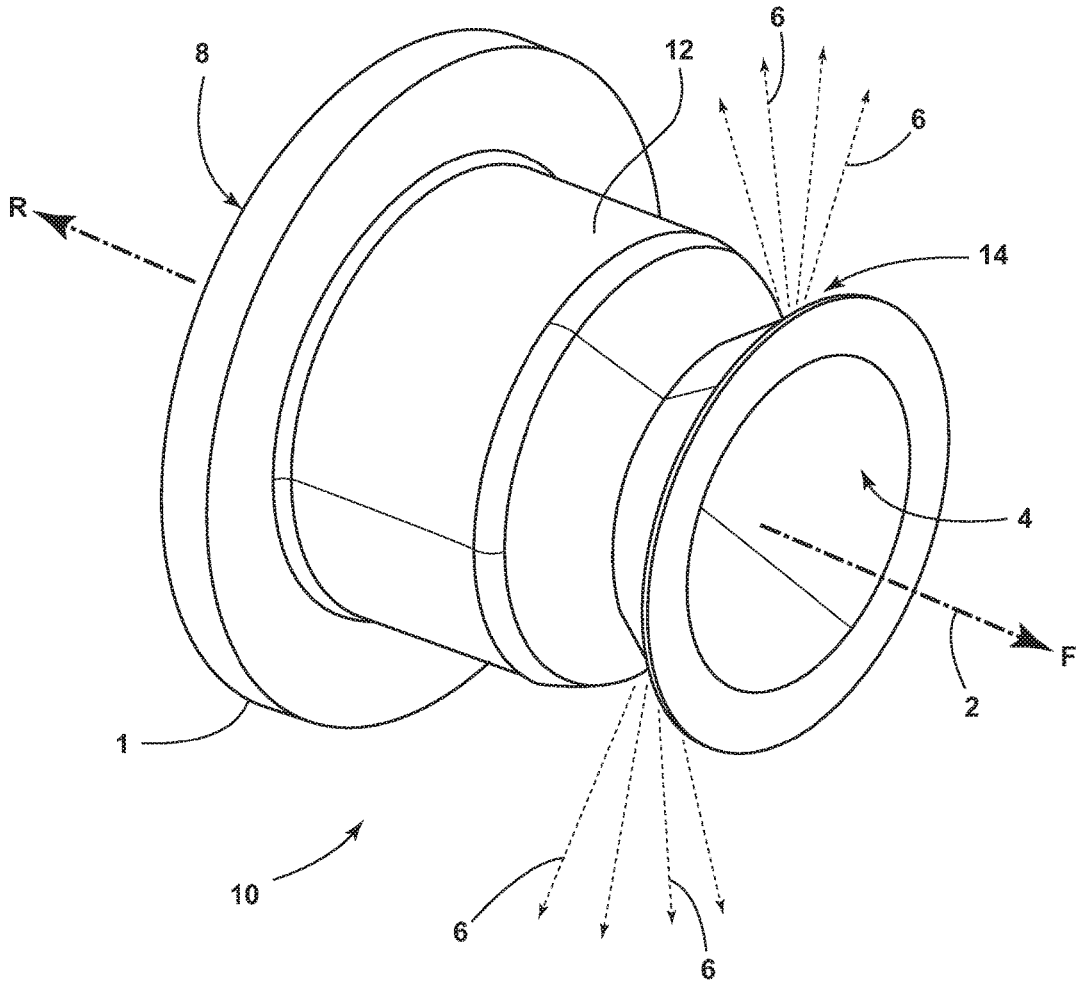
FIG. 1 is a perspective view of a lighting assembly with a near field lens having an aspherical groove according to one embodiment.

For purposes of description herein, the terms "forward," "rearward," "side," and derivatives thereof shall relate to the lighting assembly and components illustrated in FIG. 1. The "F" and "R" in FIG. 1 refer to forward and rearward directions, respectively. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a perspective view of a lighting assembly 10 is depicted with a near field lens 1 having an aspherical groove 14 according to one embodiment. The near field lens 1 has a front surface 4 oriented in the forward direction "F," and a rear surface 8 that faces an LED source (not shown in FIG. 1). As shown, the near field lens 1 is arranged symmetrically about an axis 2 that spans from the rearward direction "R" to the forward direction "F." The near field lens 1 also possesses a side surface 12 configured around the axis 2 and defined between the front surface 4 and rear surface 8. The side surface 12 includes an aspherical groove 14.

The near field lens 1 is substantially transparent. Preferably, the near field lens element is constructed of glass, polycarbonate and/or polymethyl methacrylate (PMMA) materials. As readily understood by those with ordinary skill in the art, these materials should be sufficiently transparent for optical clarity. In general, an LED source 3 facing the rear surface 8 generates a light cone 3*a* (solid angle) (not shown) in the forward direction "F" that proceeds through the rear surface 8 into the near field lens 1 by way of refraction. The light from the light cone 3*a* (solid angle) is then substantially reflected within the lens 1 at the front surface 4 toward the side surface 12. A substantial portion of the reflected light from the light cone 3*a* (solid angle) then exits the lens 1 through the aspherical groove 14 as exit cone 6. Hence, the incident light from the LED source 3 in the form of light cone 3*a* (solid angle) is directed through the near field lens 1 and redirected out of lens 1 through the aspherical groove 14.

As defined herein, the term "aspherical" is associated with certain surfaces of the near field lens elements described in this disclosure. The "aspherical" surfaces of the near field lens elements described herein have a plurality of exterior points with different radius of curvature values. As such, these surfaces are "aspherical" in the sense that they cannot be extended and enclosed to form a perfect sphere.

Figure 2:
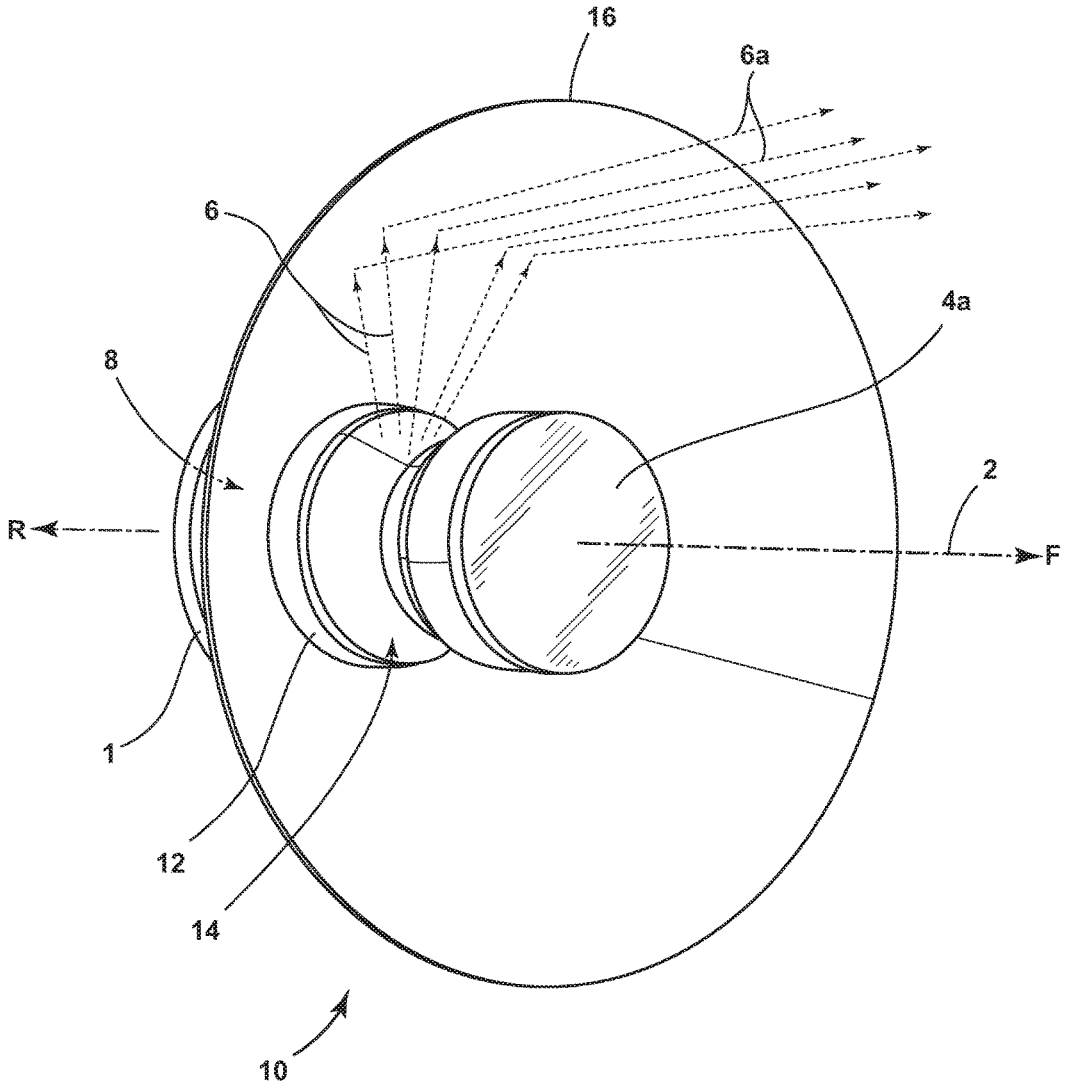
FIG. 2 is a perspective view of the lighting assembly depicted in FIG. 1 with a reflector according to another embodiment.

As shown in FIG. 2, the lighting assembly 10 depicted in FIG. 1 can be configured with a reflector 16 according to another embodiment. The reflector 16 is configured about the axis 2 and around the side surface 12 of the near field lens 1. Further, the reflector 16 is located on the axis 2 at point rearward of the aspherical groove 14. Further, the reflector 16 possesses an optically reflective exterior surface facing the forward direction "F" that is fabricated from reflective materials, as understood by those with ordinary skill in this art.

In the configuration depicted in FIG. 2, the lighting assembly 10 can harness the exit cone 6 from the lens 1 and redirect this light off of the reflector 16 in the forward direction "F." The reflected light from the exit cone 6 now emanates in the forward direction "F" in the form of a light pattern 6*a*. Preferably, the near field lens 1 and the reflector 16 are engineered to create a light pattern 6*a* in a pattern with intensity and an angular spread that is suitable for vehicular exterior lighting applications that meet the operative federal regulations.

Referring again to FIG. 2, the near field lens 1 of lighting assembly 10 is depicted with a front surface cap 4*a*. As the light cone 3*a* (solid angle) emanating from LED source 3 and travelling through lens 1 is generally internally reflected off of front surface 4 (not shown), surface 4 can be covered by the front surface cap 4*a*. The cap 4*a* can be arranged as a stylistic element associated with the lighting assembly 10. Further, in some embodiments, cap 4*a* can possess a substantially reflective interior surface that faces front surface 4 of the near field lens 1 (not shown). The reflective interior surface of cap 4*a* can then reflect any light from the light cone 3*a* (solid angle) that is not reflected internally off of front surface 4 within the lens 1. Incorporating the reflective interior surface associated with cap 4*a* can thus improve the light collection efficiency of the lighting assembly 10.

Figure 3:
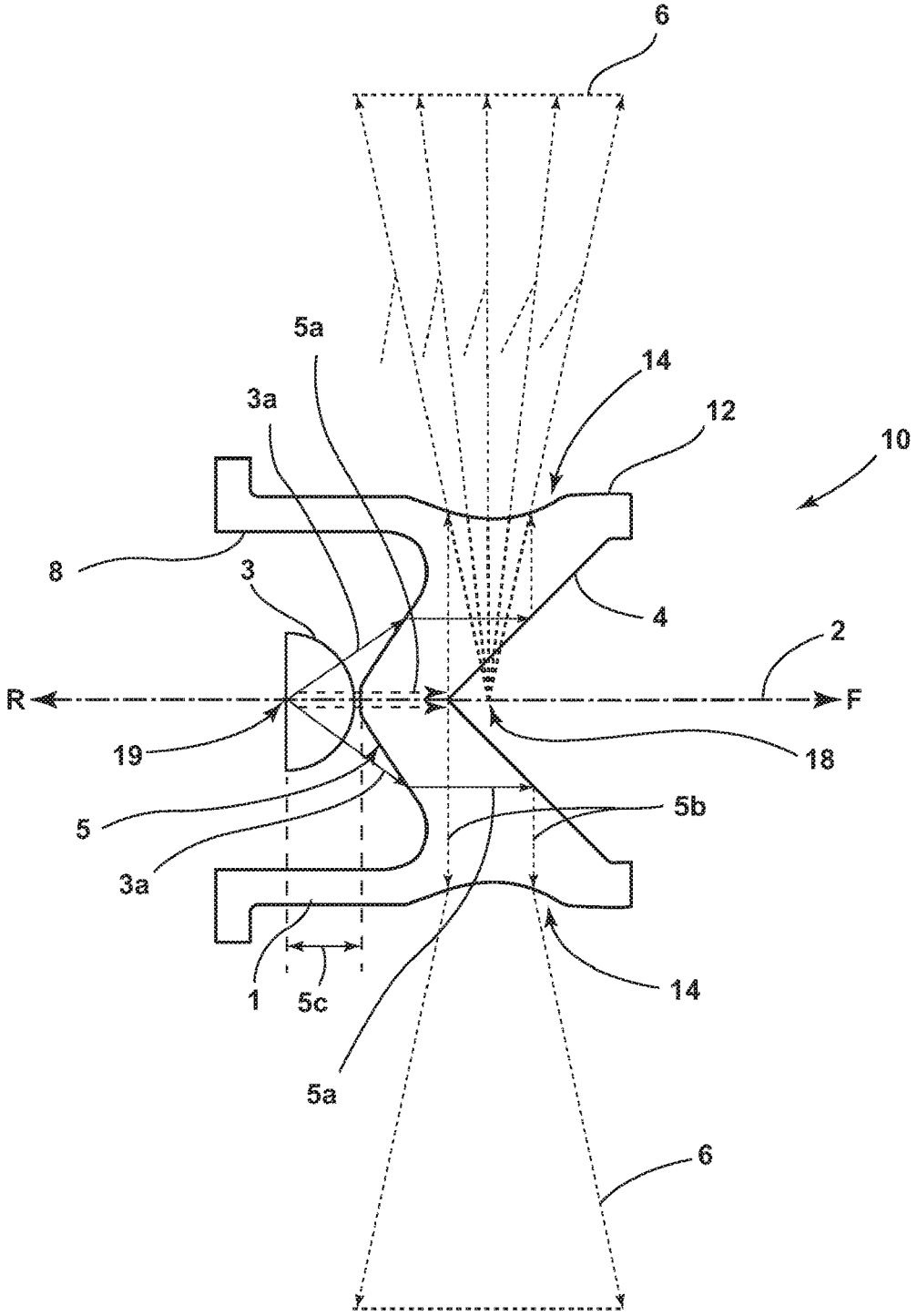
FIG. 3 is a schematic illustrating the operation of a lighting assembly with a near field lens having a collimating surface and an aspherical groove according to a further embodiment.

In depicting a cross-section of lighting assembly 10, FIG. 3 demonstrates the operation of lighting assembly 10 according to another embodiment. As shown, the lighting assembly 10 includes an LED source 3 and a transparent near field lens 1. The LED source 3 generates a light cone 3*a* (solid angle). Preferably, the LED source 3 is arranged in proximity to the rear surface 8 of the lens 1 such that light cone 3*a* (solid angle) substantially impinges on the rear surface 8. LED source 3 can comprise one or more of various LED-related lighting sources that can provide a high intensity, directional light pattern in the form of a light cone 3*a* (solid angle). Other components (not shown) can be configured to power and control the LED source 3 as understood by those with ordinary skill in the art.

The near field lens 1 of the lighting assembly 10 depicted in FIG. 3 has a front surface 4 oriented in the forward direction "F," and a rear surface 8 that faces the LED source 3. As shown, the near field lens 1 is arranged symmetrically about an axis 2 that spans from the rearward direction "R" to the forward direction "F." The rear surface 8 further comprises a collimating surface 5. Note that in some embodiments, the rear surface 8 may comprise multiple collimating surfaces (see, e.g., collimating surfaces 5 and 8*a* shown in FIG. 4D). Further, as shown in FIG. 3, the near field lens 1 also possesses a side surface 12 configured around the axis 2 and defined between the front surface 4 and rear surface 8. The side surface 12 includes an aspherical groove 14.

Referring to FIG. 3 again, the near field lens 1 of lighting assembly 10 operates as follows. The LED source 3 facing the rear surface 8 generates a light cone 3*a* (solid angle) in the forward direction "F" that proceeds through the collimating surface 5 into the near field lens 1. Preferably, the collimating surface 5 is dimensionally configured to substantially collimate the cone 3*a* (solid angle) emanating from LED source 3. As such, collimating surface 5 can be larger or smaller depending upon the degree of spread associated with the light cone 3*a* (solid angle) emanating from the particular LED source 3 employed in the lighting assembly 10. Further, collimating surface 5 can be sized based on the relative location of LED source 3 in proximity to the collimating surface 5. Preferably, collimating surface 5 is configured with a continuously varying radius of curvature.

The light from the light cone 3*a* (solid angle) is then collimated by collimating surface 5 into a beam pattern 5*a* within the near field lens 1 toward the front surface 4. The beam pattern 5*a* is then reflected within the lens 1 at the front surface 4 toward the side surface 12. Front surface 4 is preferably configured at a roughly 45° angle within near field lens 1 to ensure complete internal reflection of the beam pattern 5*a* toward the side surface 12. As such, the beam pattern 5*a* is reflected off of front surface 4 as reflected, cylindrical pattern 5*b*.

A substantial portion of the reflected cylindrical pattern 5*b* (originating from the light cone 3*a* (solid angle)) then exits the near field lens 1 through the aspherical groove 14 of side surface 12 as exit cone 6. In particular, the aspherical groove 14 directs the cylindrical pattern 5*b* away from the lens 1 as an exit cone 6 with a virtual focal point 18 via refraction according to Snell's law. Although the exit cone 6 does not pass through virtual focal point 18, its light rays can be traced back to virtual focal point 18. The aspherical groove 14 is particularly engineered to spread the cylindrical pattern 5*b* as an exit cone 6 in a direction corresponding to virtual focal point 18. The aspherical groove 14 is also engineered to ensure that the critical angle associated with the refractive index of the material selected for near field lens 1 is not violated. When viewed in three dimensions, the lighting assembly 10 produces an exit cone 6 in the shape of a cylinder (with angular faces on the rearward side "R" and the forward side "F") with light emanating radially away from axis 2. Preferably, aspherical groove 14 is engineered with a continuously varying radius of curvature.

Figure 3A:
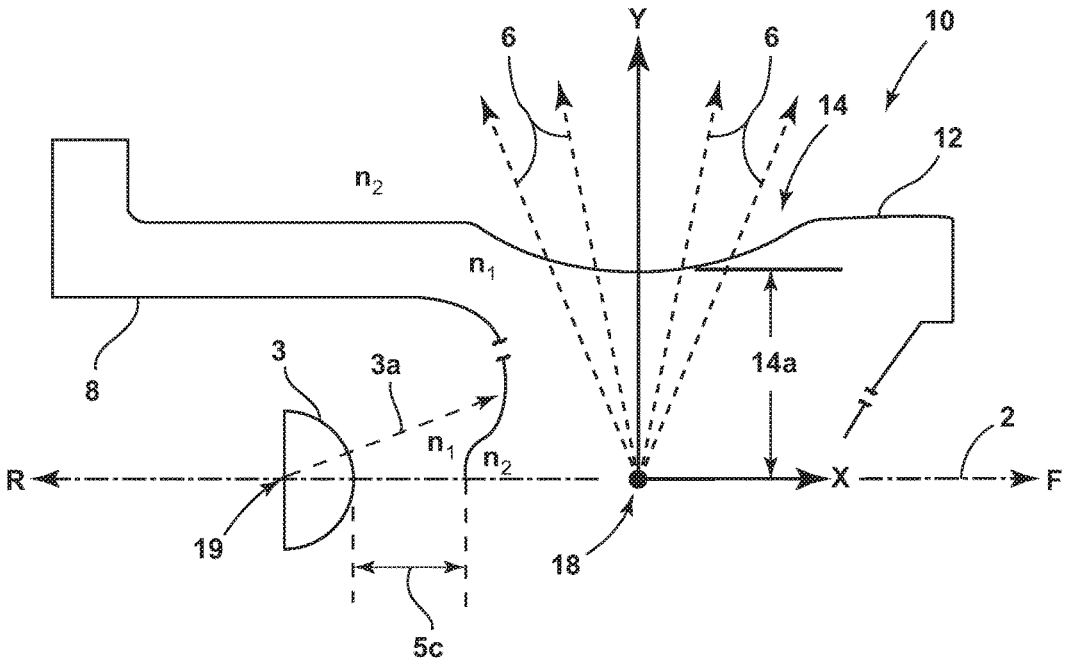
FIG. 3A is an enlarged view of the lighting assembly depicted in FIG. 3 demonstrating the development of the aspherical groove with an algorithm based on integral mathematics according to an additional embodiment.

As depicted in FIG. 3A, the aspherical groove 14 can be created using an algorithm, such as given below by Equation (1), based on integral mathematics. The aspherical groove 14 can be engineered in terms of its shape based on a desired location for virtual focal point 18 and the desired distance between virtual focal point 18 and the aspherical groove 14. In particular, the aspherical groove 14 can be created in two dimensions in the X and Y coordinates as shown. The X coordinate is along the axis 2, spanning from the rearward and forward directions, "R" and "F," respectively. The Y coordinate is normal to the X coordinate. The distance between the virtual focal point 18 (as-selected) and the bottommost point of the aspherical groove 14 toward the axis 2 is defined by focal length 14*a*, also identified as "lf" in Equation (1) below. Further, $n_1$ and $n_2$ in Equation (1), and as depicted in FIG. 3A, correspond to the refractive index values of the near field lens 1 and environment surrounding the lens 1, respectively.

As also depicted in FIG. 3A, the near field lens 1 will be surrounded by air and therefore $n_2$ will equal 1.00029 or 1 to simplify the equation. As noted earlier, lens 1 can be fabricated from a transparent material. In this example, lens 1 is fabricated of polycarbonate, giving it a refractive index, $n_1$, equal to 1.586. Equation (1) can be employed to generate the curvature associated with aspherical groove 14. For example, when the focal length 14*a*, lf, is set at 10 mm, $f(x)=11.7411$ mm at $x=5$ mm. Ultimately, the aspherical groove 14 is defined according to Equation (1) such that $f(x)$ defines the location of the aspherical groove 14 along the Y axis as a function of location along the X axis.

$$f(x)=\sqrt{\left(\left(\left(\frac{lf}{\left(\frac{\left(\frac{n_1}{n_2}+1\right)}{\left(\frac{n_1}{n_2}-1\right)}\right)}\right)^2\times\left(\left(\frac{x^2}{\left(\frac{lf}{\left(\frac{\left(\frac{n_1}{n_2}+1\right)}{\left(\frac{n_1}{n_2}-1\right)}\right)}\right)^2\times\left(\frac{\left(\frac{n_1}{n_2}+1\right)}{\left(\frac{n_1}{n_2}-1\right)}\right)}\right)+1\right)\right)}+\left(\frac{\left(\frac{n_1}{n_2}\right)\times\left(\frac{lf}{\left(\frac{\left(\frac{n_1}{n_2}+1\right)}{\left(\frac{n_1}{n_2}-1\right)}\right)}\right)}{\left(\frac{n_1}{n_2}-1\right)}\right)} \tag{1}$$

Referring to FIGS. 3 and 3A, it should also be understood that aspherical collimating surface 5 can be created using an algorithm based on integral mathematics that is similar to Equation (1). In particular, Equation (2) below can be employed to generate the curvature associated with the collimating surface 5. In this example, $n_1$ will represent air with a refractive index of 1.00029 or 1 (to simplify the equation) and $n_2$ will represent the transparent material polycarbonate with a refractive index of 1.586. The X and Y directions employed in Equation (2) relative to the collimating surface 5 shown in FIGS. 3 and 3A are shifted 90 degrees relative to those employed in Equation (1) for aspherical groove 14. Further, the lf term in the Equation (2) corresponds to the focal length 5*c* for the collimating surface 5, defined by the distance in the axis 2 direction between the LED focal point 19 and the center point of the collimating surface 5 (not shown in FIG. 3). As such, $f(x)$ in Equation (2) can be used to define the collimating surface 5 in the axis 2 direction (along the axis formed by the "R" and "F" directions) as a function of the X direction, defined normal to the axis 2. It should be understood that there are many ways to create a collimated beam through collimating surface 5 into near field lens 1, whether by a single or multiple surfaces. Hence, the algorithms employed in Equation (2) are merely exemplary.

$$f(x)=\sqrt{\left(\left(\frac{lf}{\left(\frac{\left(\frac{n_2}{n_1}+1\right)}{\left(\frac{n_2}{n_1}-1\right)}\right)}\right)^2\times\left(\left(\frac{x^2}{\left(\frac{lf}{\left(\frac{\left(\frac{n_2}{n_1}+1\right)}{\left(\frac{n_2}{n_1}-1\right)}\right)}\right)^2\times\left(\frac{\left(\frac{n_2}{n_1}+1\right)}{\left(\frac{n_2}{n_1}-1\right)}\right)}\right)+1\right)\right)}+ \tag{2}$$

-continued $$\left(\frac{\left(\frac{n_2}{n_1}\right)\times\left(\frac{lf}{\left(\frac{\left(\frac{n_2}{n_1}+1\right)}{\left(\frac{n_2}{n_1}-1\right)}\right)}\right)}{\left(\frac{n_2}{n_1}-1\right)}\right)$$

Figure 4A:
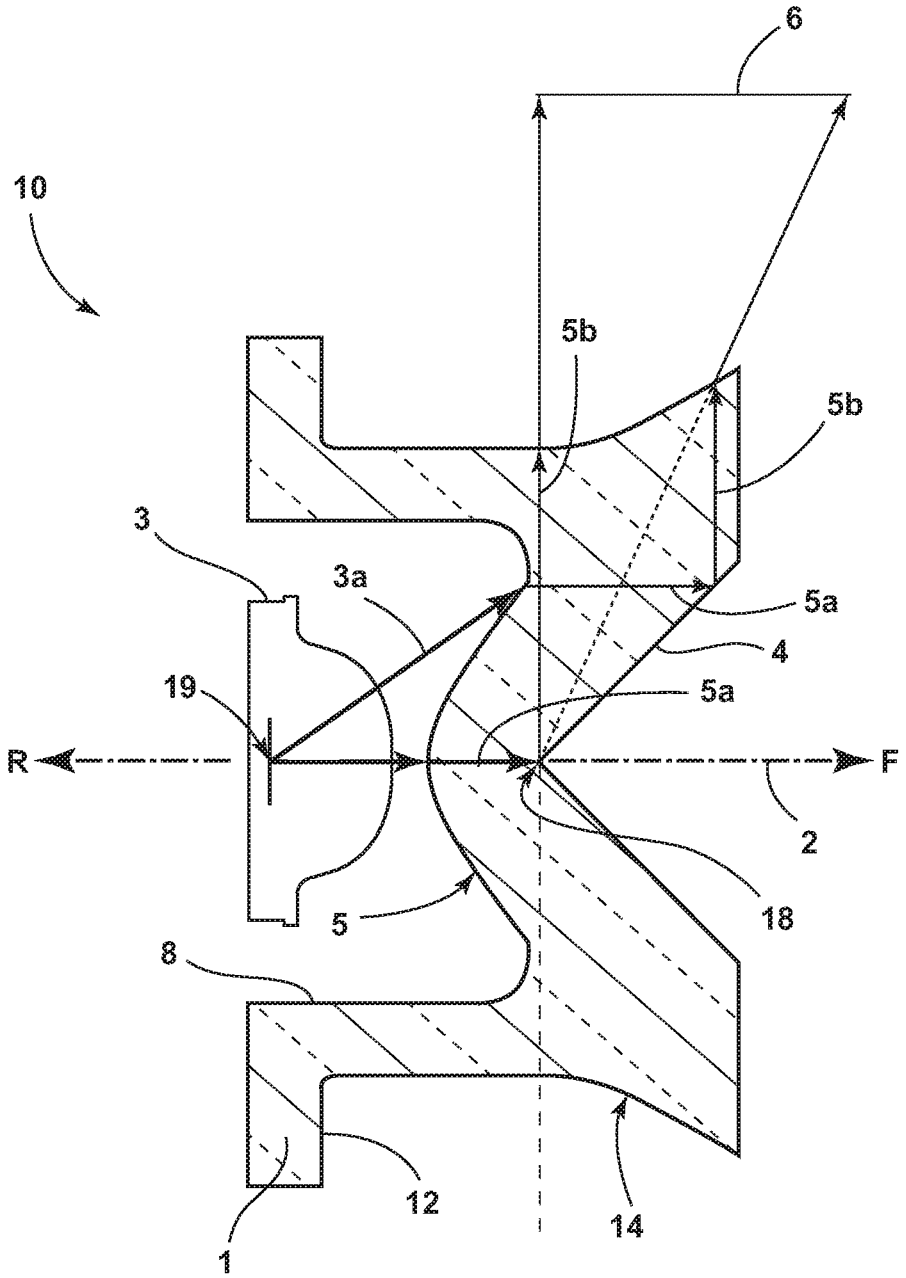
FIG. 4A is a cross-sectional view of a lighting assembly with a near field lens having a collimating surface and an aspherical groove configured to direct an exit light cone from a virtual focal point in a substantially forward collective direction relative to the virtual focal point according to a further embodiment.
Figure 4B:
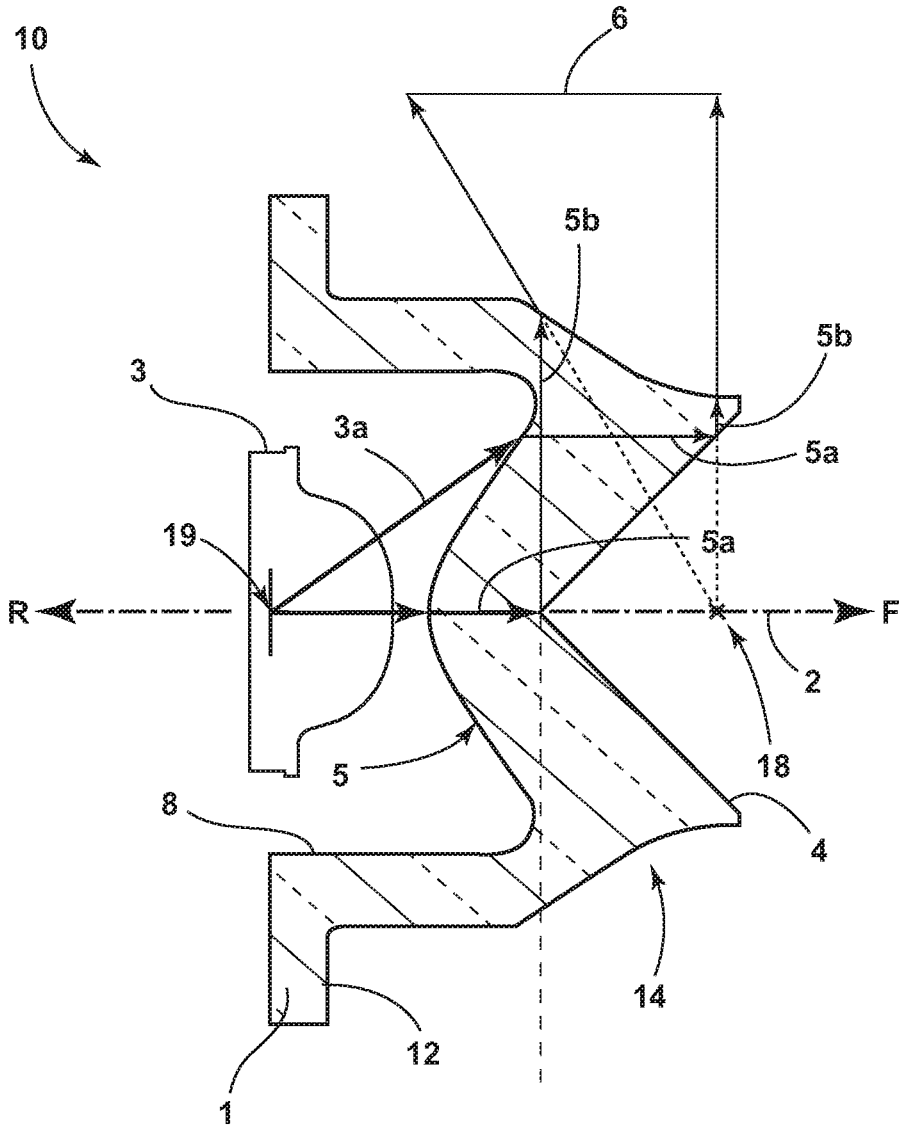
FIG. 4B is a cross-sectional view of a lighting assembly with a near field lens having a collimating surface and an aspherical groove configured to direct an exit light cone from a virtual focal point in a substantially rearward collective direction relative to the virtual focal point according to another embodiment.
Figure 4C:
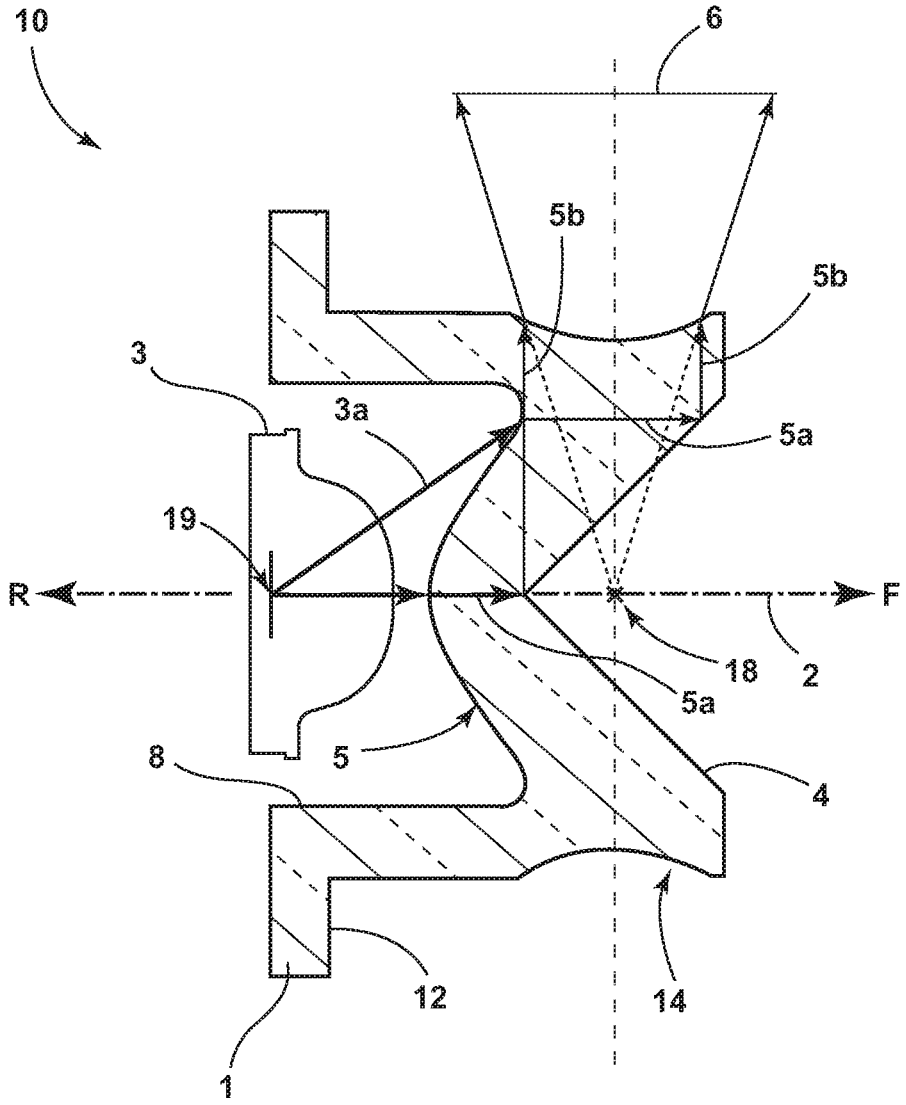
FIG. 4C is a cross-sectional view of a lighting assembly with a near field lens having a collimating surface and an aspherical groove configured to direct an exit light cone from a virtual focal point in a collective direction that is substantially evenly distributed in the forward and rearward directions relative to the virtual focal point according to a further embodiment.

Additional embodiments of lighting assembly 10 are depicted in FIGS. 4A-4C. In FIG. 4A, a cross-section of a lighting assembly 10 is depicted in which the near field lens 1 is configured to produce an exit cone 6 from a virtual focal point 18 in a substantially forward direction relative to the virtual focal point 18. As shown in FIG. 4A, the aspherical groove 14 is particularly engineered to refract cylindrical pattern 5*b* in a forward direction such that a substantial portion of light rays in exit cone 6 have a forward direction "F" component. All of the light rays that form exit cone 6 can be traced back in the direction of virtual focal point 18. Preferably, the virtual focal point 18 resides within or in proximity to near field lens 1 when the aspherical groove 14 is engineered to produce a substantially forward-oriented exit cone 6. Further, a reflector 16 can be engineered and fitted to the lighting assembly 10 of FIG. 4A to collect and reflect the exit cone 6 as a light pattern 6*a* (see FIG. 2). Preferably, the reflector 16 is configured as a parabolic reflector (e.g., a paraboloid shape) having a focal point consistent with virtual focal point 18.

In FIG. 4B, a cross-section of a lighting assembly 10 is depicted in which the near field lens 1 is configured to produce an exit cone 6 from a virtual focal point 18 in a substantially rearward direction relative to the virtual focal point 18. As shown in FIG. 4B, the aspherical groove 14 is particularly engineered to refract cylindrical pattern 5*b* in a rearward direction such that a substantial portion of light rays in exit cone 6 have a rearward direction "R" component. All of the light rays that form exit cone 6 can be traced back in the direction of virtual focal point 18. Preferably, the virtual focal point 18 resides forward of front surface 4 of near field lens 1 when the aspherical groove 14 is engineered to produce a substantially rearward-oriented exit cone 6. Further, a reflector 16 can be engineered and fitted to the lighting assembly 10 of FIG. 4B to collect and reflect the exit cone 6 as a light pattern 6*a* (see FIG. 2). Preferably, the reflector 16 is configured as a parabolic reflector (e.g., a paraboloid shape) having a focal point consistent with virtual focal point 18.

Referring to FIG. 4C, a cross-section of a lighting assembly 10 is depicted in which the near field lens 1 is configured to produce an exit cone 6 from a virtual focal point 18 in a collective direction that is substantially evenly distributed in the forward and rearward directions "F" and "R" relative to the virtual focal point 18. As shown in FIG. 4C, the aspherical groove 14 is particularly engineered to refract cylindrical pattern 5*b* in a substantially uniform fashion such that roughly equivalent portions of the light rays in exit cone 6 have a rearward direction "R" component or a forward direction "F" component, respectively. All of the light rays that form exit cone 6 can be traced back in the direction of virtual focal point 18. Preferably, the virtual focal point 18 resides centrally located to cylindrical pattern 5*b* of near field lens 1. Further, a reflector 16 can be engineered and fitted to the lighting assembly 10 of FIG. 4C to collect and reflect the exit cone 6 as a light pattern 6*a* (see FIG. 2). Preferably, the reflector 16 is configured as a parabolic reflector (e.g., a paraboloid shape) having a focal point consistent with virtual focal point 18.

Figure 4D:
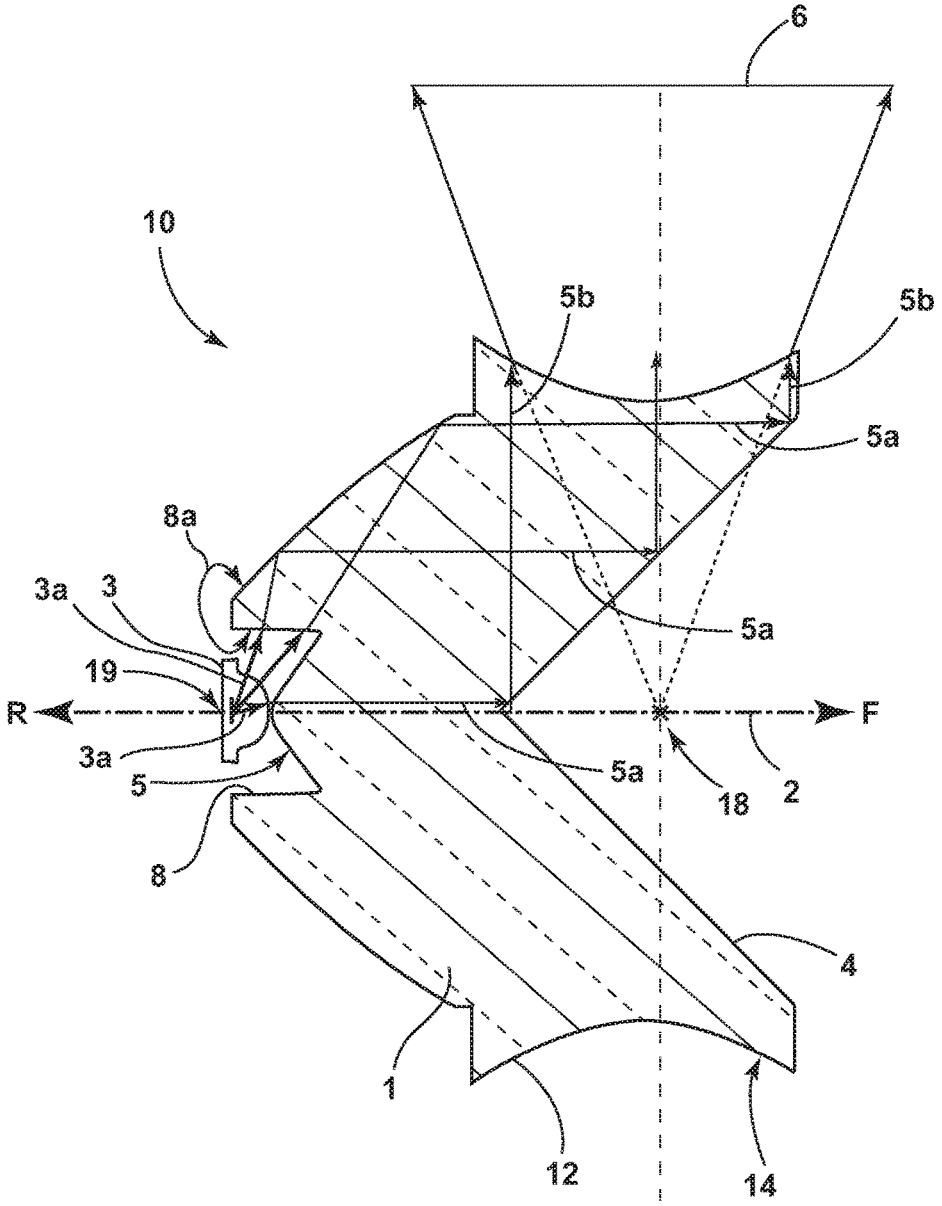
FIG. 4D is a cross-sectional view of a lighting assembly with a near field lens having a plurality of collimating surfaces and an aspherical groove configured to direct an exit light cone from a virtual focal point in a collective direction that is substantially evenly distributed in the forward and rearward directions relative to the virtual focal point according to another embodiment.

Referring to FIG. 4D, a cross-section of a lighting assembly 10 is depicted in which the near field lens 1 is configured with multiple collimating surfaces, collimating surface 5 and collimating surfaces 8*a*, to produce an exit cone 6 from a virtual focal point 18 in a collective direction that is substantially evenly distributed in the forward and rearward directions "F" and "R" relative to the virtual focal point 18. In particular, the LED source 3 facing the rear surface 8 generates a light cone 3*a* (solid angle) in the forward direction "F" that proceeds through the collimating surface 5 and collimating surface 8*a*, into the near field lens 1. Further, the interior side of collimating surface 8*a* also collimates some of the light that has refracted through another region of collimating surface 8*a*. Preferably, the collimating surfaces 5 and 8*a* are dimensionally configured to substantially collimate the cone 3*a* (solid angle) emanating from LED source 3. As such, collimating surfaces 5 and 8*a* can be larger or smaller depending upon the degree of spread associated with the light cone 3*a* (solid angle) emanating from the particular LED source 3 employed in the lighting assembly 10. Further, collimating surfaces 5 and 8*a* can be sized based on the relative location of LED source 3 in proximity to the collimating surfaces 5 and 8*a*.

The light from the light cone 3*a* (solid angle) is then collimated by collimating surfaces 5 and 8*a* into a beam pattern 5*a* within the near field lens 1 toward the front surface 4. The beam pattern 5*a* is then reflected within the lens 1 at the front surface 4 toward the side surface 12. Front surface 4 is preferably configured at a roughly 45° angle within near field lens 1 to ensure complete internal reflection of the beam pattern 5*a* toward the side surface 12. As such, the beam pattern 5*a* is reflected off of front surface 4 as reflected, cylindrical pattern 5*b*.

As further shown in FIG. 4D, the aspherical groove 14 is particularly engineered to refract cylindrical pattern 5*b* in a substantially uniform fashion such that roughly equivalent portions of the light rays in exit cone 6 have a rearward direction "R" component or a forward direction "F" component, respectively. All of the light rays that form exit cone 6 can be traced back in the direction of virtual focal point 18. Preferably, the virtual focal point 18 resides centrally located to cylindrical pattern 5*b* of near field lens 1. Further, a reflector 16 can be engineered and fitted to the lighting assembly 10 of FIG. 4D to collect and reflect the exit cone 6 as a light pattern 6*a* (see FIG. 2). Preferably, the reflector 16 is configured as a parabolic reflector (e.g., a paraboloid shape) having a focal point consistent with virtual focal point 18.

Figure 5:
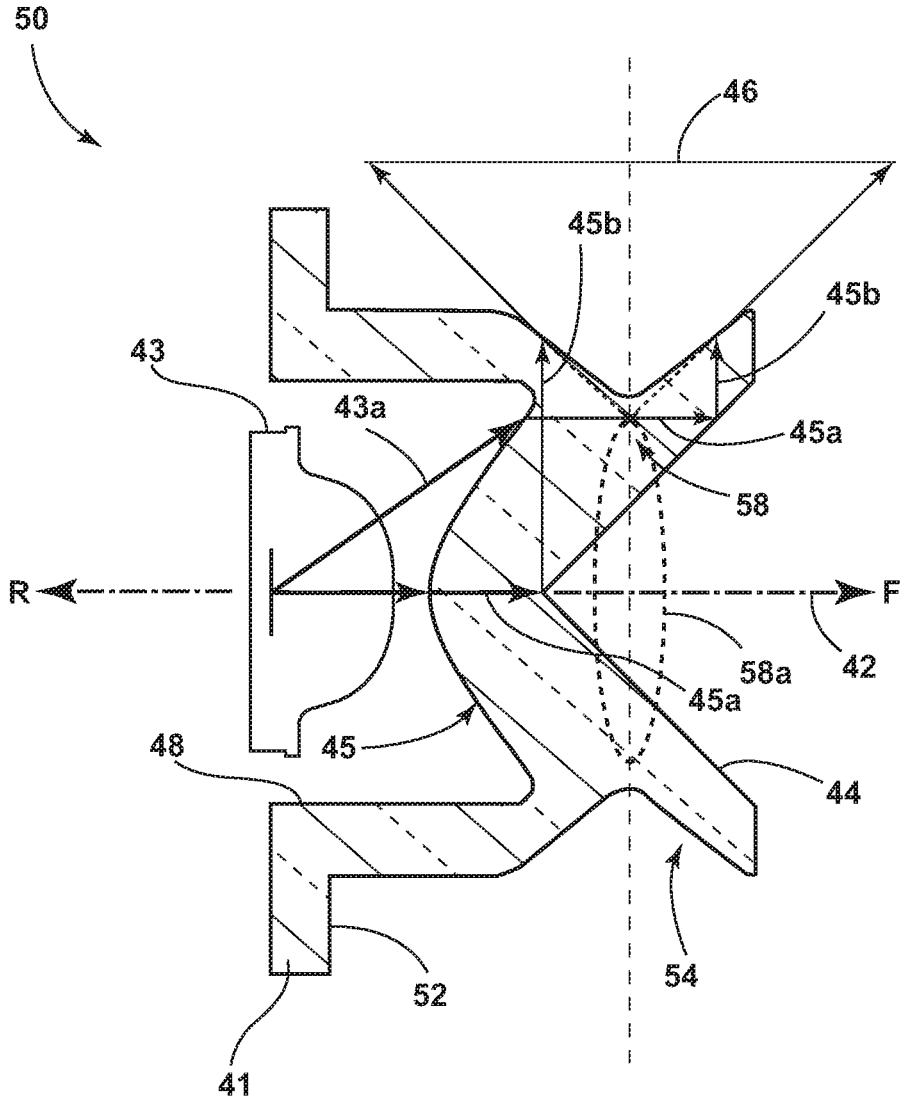
FIG. 5 is a cross-sectional view of a lighting assembly with a near field lens having a collimating surface and an aspherical groove configured to direct an exit light cone from a positive virtual focal ring according to an additional embodiment.

Referring to FIG. 5, a lighting assembly 50 is depicted according to another embodiment in a cross-sectional view. Notably, lighting assembly 50 possesses a near field lens 41 having a collimating surface 45 and an aspherical groove 54 configured to direct an exit light cone 46 from a positive virtual focal ring 58*a*. Equations (1) and (2) can be employed to create the aspherical groove 54 and collimating surface 45, respectively. As shown, the lighting assembly 50 includes an LED source 43 and a transparent near field lens 41. The LED source 43 generates a light cone 43*a* (solid angle). It is preferable for the LED source 43 to be arranged in proximity to the rear surface 48 of the lens 41 such that light cone 43*a* (solid angle) substantially impinges on the rear surface 48. LED source 43 can comprise one or more of various LED-related lighting sources that can provide a high intensity, directional light pattern in the form of a light cone 43*a* (solid angle). As understood by those with ordinary skill, other components (not shown) can be configured to power and control the LED source 43.

The near field lens 41 of the lighting assembly 50 depicted in FIG. 5 has a front surface 44 oriented in the forward direction "F," and a rear surface 48 that faces the LED source 43. As shown, the near field lens 41 is arranged symmetrically about an axis 42 that spans from the rearward direction "R" to the forward direction "F". The rear surface 48 further comprises a collimating surface 45. In addition, the near field lens 41 also possesses a side surface 52 configured around the axis 42 and defined between the front surface 44 and rear surface 48. The side surface 52 includes an aspherical groove 54.

Referring to FIG. 5 again, the near field lens 41 of lighting assembly 50 operates as follows. The LED source 43 facing the rear surface 48 generates a light cone 43*a* (solid angle) in the forward direction "F" that proceeds through the collimating surface 45 into the near field lens 41. Preferably, the collimating surface 45 is dimensionally configured to substantially collimate the light cone 43*a* (solid angle) emanating from LED source 43. Collimating surface 45 can therefore be larger or smaller depending upon the degree of spread associated with the light cone 43*a* (solid angle) emanating from the particular LED source 43 employed in the lighting assembly 50. In addition, collimating surface 45 can be sized based on its location in proximity to the location of LED source 43.

The light from the light cone 43*a* (solid angle) is then collimated by collimating surface 45 into a beam pattern 45*a* within the near field lens 41 toward the front surface 44 in the forward direction "F." The beam pattern 45*a* is then reflected within the lens 41 at the front surface 44 toward the side surface 52. Front surface 44 is preferably configured at a roughly 45° angle within near field lens 41 to ensure complete internal reflection of the beam pattern 45*a* toward the side surface 52. As such, the beam pattern 45*a* is reflected off of front surface 44 as reflected cylindrical pattern 45*b*.

A substantial portion of the reflected cylindrical pattern 45*b* (originating from the light cone 43*a* (solid angle)) then exits the near field lens 41 through the aspherical groove 54 of side surface 52 as exit cone 46. In particular, the aspherical groove 54 directs the cylindrical pattern 45*b* away from the lens 41 as an exit cone 46 with a virtual focal point 58 via refraction according to Snell's law. Although the exit cone 46 does not pass through virtual focal point 58, its light rays can be traced back to virtual focal point 58. In particular, the aspherical groove 54 is engineered to spread the cylindrical pattern 45*b* as an exit cone 46 in a direction corresponding to virtual focal point 58. The aspherical groove 54 is also engineered to ensure that the critical angle associated with the refractive index of the material selected for near field lens 41 is not violated.

Further, the virtual focal point 58 is situated above the axis 42 and aspherical groove 54. As a consequence, each cross-sectional view of lighting assembly 50 and near field lens 41 will depict a virtual focal point 58 at a different location in space. Together, these virtual focal points 58 trace a positive virtual focal ring 58*a*, denoted in perspective as a dotted ellipse in FIG. 5. Hence, a plurality of exit cones 46 emanate from the positive virtual focal ring 58*a* when lighting assembly 50 is viewed in perspective in three dimensions.

Referring further to FIG. 5, the exit cone 46 of lighting assembly 50 is in the shape of a cylinder (with angular faces on the rearward side "R" and the forward side "F") with light emanating radially away from axis 42 when the cone 46 is viewed in three dimensions. Preferably, aspherical groove 54 is engineered with a continuously varying radius of curvature to produce virtual focal points 58 and positive virtual focal ring 58*a*. It should also be understood that the exit cone 46 associated with lighting assembly 50 with a positive virtual focal ring 58*a* possesses a large angular spread, preferably greater than 45°. As such, the cylindrical shape of exit cone 46 (as viewed in three dimensions) is a cylinder with a large height dimension along the axis 42. It should be understood that the techniques for shifting the exit cone 6 in the lighting assemblies 10 depicted in FIGS. 4A and 4B can also be applied to shift the exit cone 46 of lighting assembly 50 depicted in FIG. 5.

Further, a reflector 16 (see FIG. 2) can be engineered and fitted to the lighting assembly 50 of FIG. 5 to collect and reflect the exit cone 46 as a light pattern directed substantially in the forward direction "F" (not shown). Preferably, the reflector 16 employed in connection with lighting assembly 50 is configured as an aparabolic reflector (e.g., a substantially paraboloid-like shape using a parabolic curve built from a virtual focal point and revolved around the central axis 42) having a plurality of focal points consistent with the virtual focal ring 58*a*. Given the relatively large angular spread of the exit cone 46, the reflector 16 must be sufficiently large to reflect all of the light from exit cone 46. A light pattern with a large angular spread generated by a lighting assembly 50 could be employed in certain vehicular exterior lighting applications, to support such functions as daytime running lamp (DRL), stop, turn, etc.

Figure 6:
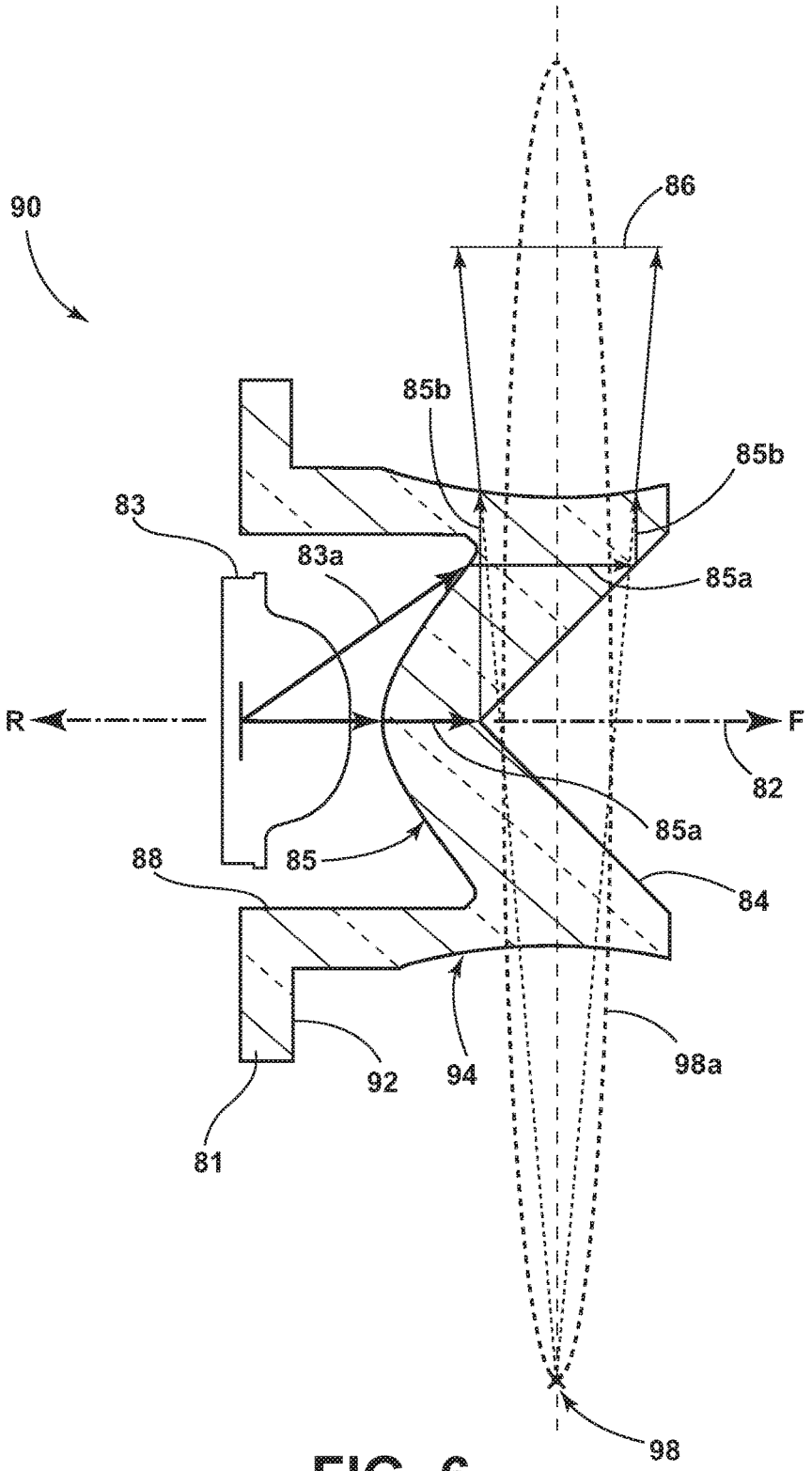
FIG. 6 is a cross-sectional view of a lighting assembly with a near field lens having a collimating surface and an aspherical groove configured to direct an exit light cone from a negative virtual focal ring according to another embodiment.

Referring to FIG. 6, a lighting assembly 90 is depicted according to an additional embodiment in a cross-sectional view. Lighting assembly 90 possesses a near field lens 81 having a collimating surface 85 and an aspherical groove 94 configured to direct an exit light cone 86 from a negative virtual focal ring 98*a*. Equations (1) and (2) can be employed to create the aspherical groove 94 and collimating surface 85, respectively. As shown, the lighting assembly 90 includes an LED source 83 and a transparent near field lens 81. The LED source 83 generates a light cone 83*a* (solid angle). Preferably, the LED source 83 is arranged in proximity to the rear surface 88 of the lens 81 such that light cone 83*a* (solid angle) substantially impinges on the rear surface 88. LED source 83 can comprise one or more of various LED-related lighting sources that can provide a high intensity, directional light pattern in the form of a light cone 83*a* (solid angle). As readily understood by those with ordinary skill, other components (not shown) can be configured to power and control the LED source 83.

The near field lens 81 of the lighting assembly 90 depicted in FIG. 6 has a front surface 84 oriented in the forward direction "F," and a rear surface 88 that faces the LED source 83. As shown, the near field lens 81 is arranged symmetrically about an axis 82 that spans from the rearward direction "R" to the forward direction "F". The rear surface 88 further comprises a collimating surface 85. In addition, the near field lens 81 also possesses a side surface 92 configured around the axis 82 and defined between the front surface 84 and rear surface 88. The side surface 92 includes an aspherical groove 94.

Referring again to FIG. 6, the near field lens 81 of lighting assembly 90 operates as follows. The LED source 83 facing the rear surface 88 generates a light cone 83*a* (solid angle) in the forward direction "F" that proceeds through the collimating surface 85 into the near field lens 81. Preferably, the collimating surface 85 is dimensionally configured to substantially collimate the cone 83*a* (solid angle) emanating from LED source 83. Collimating surface 85 can therefore be sized based upon the degree of spread associated with the light cone 83*a* (solid angle) emanating from the particular LED source 83 employed in the lighting assembly 90. In addition, the collimating surface 85 can be sized based on its location in proximity to the location of LED source 43.

The light from the light cone 83*a* (solid angle) is then collimated by collimating surface 85 into a beam pattern 85*a* within the near field lens 81 toward the front surface 84 in the forward direction "F". The beam pattern 85*a* is then reflected within the lens 81 at the front surface 84 toward the side surface 92. Front surface 84 is preferably configured at a roughly 45° angle within near field lens 81 to ensure complete internal reflection of the beam pattern 85*a* toward the side surface 92. As such, the beam pattern 85*a* is reflected off of front surface 84 as reflected cylindrical pattern 85*b*.

A substantial portion of the cylindrical beam pattern 85*b* (originating from the light cone 83*a*) then exits the near field lens 81 through the aspherical groove 94 of side surface 92 as exit cone 86. In particular, the aspherical groove 94 directs the cylindrical pattern 85*b* away from the lens 81 as an exit cone 86 with a virtual focal point 98 via refraction according to Snell's law. Although the exit cone 86 does not pass through virtual focal point 98, its light rays can be traced back to virtual focal point 98. In particular, the aspherical groove 94 is engineered to spread the cylindrical pattern 85*b* as an exit cone 86 in a direction corresponding to virtual focal point 98. The aspherical groove 94 is also engineered to ensure that the critical angle associated with the refractive index of the material selected for near field lens 81 is not violated.

Further, the virtual focal point 98 is situated below the axis 82, and outside of the near field lens 81 and aspherical groove 94. As a consequence, each cross-sectional view of lighting assembly 90 and near field lens 81 will depict a virtual focal point 98 at a different location in space. Together, these virtual focal points 98 trace a negative virtual focal ring 98*a*, denoted in perspective as a dotted ellipse in FIG. 6. Hence, a plurality of exit cones 86 emanate from the negative virtual focal ring 98*a* when lighting assembly 90 is viewed in perspective in three dimensions.

Referring further to FIG. 6, the exit cone 86 of lighting assembly 90 is in the shape of a cylinder (with angular faces on the rearward side "R" and the forward side "F") with light emanating radially away from axis 82 when the cone 86 is viewed in three dimensions. Preferably, aspherical groove 94 is engineered with a continuously varying radius of curvature to produce virtual focal points 98 and negative virtual focal ring 98*a*. It should also be understood that the exit cone 86 associated with lighting assembly 90 with a negative virtual focal ring 98*a* possesses a small angular spread, typically less than 45°. As such, the cylindrical shape of exit cone 86 (as viewed in three dimensions) is a cylinder with a small height dimension along the axis 82. It should be understood that the techniques for shifting the exit cone 6 in the lighting assemblies 10 depicted in FIGS. 4A and 4B can also be applied to shift the exit cone 86 of lighting assembly 90 depicted in FIG. 6.

Further, a reflector 16 (see FIG. 2) can be engineered and fitted to the lighting assembly 90 of FIG. 6 to collect and reflect the exit cone 86 as a light pattern directed substantially in the forward direction "F" (not shown). Preferably, the reflector 16 employed in connection with lighting assembly 90 is configured as an aparabolic reflector (e.g., a substantially paraboloid-like shape using a parabolic curve built from a virtual focal point and revolved around the central axis 82) having a plurality of focal points consistent with the virtual focal ring 98*a*. Given the relatively small angular spread of the exit cone 86, the reflector 16 can be comparably packaged with small dimensions sufficient to reflect all of the light from exit cone 86. The net effect is an advantageously narrow angular spread (compared to the broad pattern produced by lighting assembly 50) in the forward direction "F," significantly larger in angular spread that the light cone 83*a* (solid angle) that emanates from the LED source 83. An intense light pattern with a relatively narrow angular spread generated by a lighting assembly 90 could be employed in certain vehicular exterior lighting applications to support such functions as DRL, stop, turn, etc.

The lighting assembly embodiments described in the foregoing, including lighting assemblies 10, 50 and 90, advantageously harness the benefits of LED-based lighting sources (e.g., power consumption), while providing angular spreads typically associated with incandescent applications. Further, these lighting assemblies employ near field lenses with one or more collimating surface(s) and aspherical groove elements that advantageously utilize side-emitting NFL technology, but further provide the precise optical design control associated with virtual focal points and virtual focal rings. With known and precise virtual focal points and virtual focal rings, depending upon the type of lighting assembly employed, it is possible to engineer other exterior lighting components (e.g., reflectors) to more efficiently harness the light emanating from the NFLs associated with these lighting assemblies. One significant advantage associated with these engineered lighting assemblies is the ability to reduce the overall aspect ratio of the exterior lighting assembly, or otherwise optimize the packaging of the assembly, as compared to conventional incandescent lighting technologies.

It is to be understood that variations and modifications can be made on the aforementioned structure including, but not limited to, the collimation surface or surfaces, and associated algorithms, without departing from the concepts of the present invention, and further it is to be understood that such concepts are intended to be covered by the following claims unless these claims by their language expressly state otherwise.

What is claimed is:

1. A lighting assembly, comprising:

an LED source that generates a light cone; and a transparent near field lens having a front surface, a collimating surface, and an aspherical groove, wherein the collimating surface collimates the light cone into a beam that reflects off of the front surface toward the aspherical groove, the groove directing the beam away from the lens as an exit cone from a virtual focal ring.

2. The lighting assembly according to claim 1, wherein the near field lens is configured in proximity to the LED source such that the collimating surface collimates a substantial portion of the light cone into the beam that reflects off of the front surface toward the aspherical groove.

3. The lighting assembly according to claim 1, wherein the aspherical groove possesses a continuously varying radius of curvature.

4. The lighting assembly according to claim 1, wherein the aspherical groove is configured to direct the beam away from the lens as the exit cone from the virtual focal ring in a collective direction that is substantially evenly distributed in forward and rearward directions relative to the virtual focal ring, the virtual focal ring a positive virtual focal ring.

5. The lighting assembly according to claim 1, wherein the aspherical groove is configured to direct the beam away from the lens as the exit cone from the virtual focal ring in a collective direction that is substantially evenly distributed in forward and rearward directions relative to the virtual focal ring, the virtual focal ring a negative virtual focal ring.

6. The lighting assembly according to claim 1, wherein the aspherical groove is configured to direct the beam away from the lens as the exit cone from the virtual focal ring in a substantially vehicle forward direction relative to the virtual focal ring, the virtual focal ring a positive virtual focal ring.

7. The lighting assembly according to claim 1, wherein the aspherical groove is configured to direct the beam away from the lens as the exit cone from the virtual focal ring in a substantially vehicle rearward direction relative to the virtual focal ring, the virtual focal ring a positive virtual focal ring.

8. The lighting assembly according to claim 1, wherein the aspherical groove is configured to direct the beam away from the lens as the exit cone from the virtual focal ring in a substantially vehicle forward direction relative to the virtual focal ring, the virtual focal ring a negative virtual focal ring.

9. The lighting assembly according to claim 1, wherein the aspherical groove is configured to direct the beam away from the lens as the exit cone from the virtual focal ring in a substantially vehicle rearward direction relative to the virtual focal ring, the virtual focal ring a negative virtual focal ring.

10. The lighting assembly according to claim 1, further comprising:

a parabolic reflector configured to reflect the exit cone in a vehicular exterior lighting pattern.

11. A light assembly, comprising:

an LED source;

a transparent near field lens having a front surface, a collimating surface, and an aspherical groove shaped to direct a light cone from the source and collimating surface as an exit cone distributed from a virtual focal ring in a substantially vehicle rearward collective direction relative to the focal ring; and a parabolic reflector for reflecting the exit cone into a vehicular light pattern.

12. The lighting assembly according to claim 11, wherein the near field lens is configured in proximity to the LED source such that the collimating surface collimates a substantial portion of the light cone into the beam that reflects off of the front surface toward the aspherical groove.

13. The lighting assembly according to claim 11, wherein the aspherical groove possesses a continuously varying radius of curvature.

14. The lighting assembly according to claim 11, wherein the virtual focal ring is a positive virtual focal ring.

15. The lighting assembly according to claim 11, wherein the virtual focal ring is a negative virtual focal ring.

16. A light assembly, comprising:

an LED source;

a transparent near field lens having a front surface, a collimating surface, and an aspherical groove shaped to direct a light cone from the source and collimating surface as an exit cone distributed from a virtual focal ring in a substantially vehicle forward collective direction relative to the focal ring; and a parabolic reflector for reflecting the exit cone into a vehicular light pattern.

17. The lighting assembly according to claim 16, wherein the near field lens is configured in proximity to the LED source such that the collimating surface collimates a substantial portion of the light cone into the beam that reflects off of the front surface toward the aspherical groove.

18. The lighting assembly according to claim 16, wherein the aspherical groove possesses a continuously varying radius of curvature.

19. The lighting assembly according to claim 16, wherein the virtual focal ring is a positive virtual focal ring.

20. The lighting assembly according to claim 16, wherein the virtual focal ring is a negative virtual focal ring.

* * * * *